US009400160B1

(12) United States Patent
Miles

(10) Patent No.: US 9,400,160 B1
(45) Date of Patent: Jul. 26, 2016

(54) BROAD HEAD ARROW TIP AND ASSOCIATED METHODS

(71) Applicant: Christopher Ray Miles, Springville, UT (US)

(72) Inventor: Christopher Ray Miles, Springville, UT (US)

( * ) Notice: Subject to any disclaimer, the term of this patent is extended or adjusted under 35 U.S.C. 154(b) by 0 days.

(21) Appl. No.: 14/589,901

(22) Filed: Jan. 5, 2015

(51) Int. Cl.
*F42B 6/08* (2006.01)
*F42B 12/34* (2006.01)

(52) U.S. Cl.
CPC .. *F42B 6/08* (2013.01); *F42B 12/34* (2013.01)

(58) Field of Classification Search
CPC ..... F42B 6/08
See application file for complete search history.

(56) References Cited

U.S. PATENT DOCUMENTS 5,564,713 A * 10/1996 Mizek ..... F42B 6/08 473/583
5,941,784 A 8/1999 Mizek
6,283,880 B1 * 9/2001 Barrie ..... F42B 6/08 473/584
8,801,552 B2 8/2014 Miles

* cited by examiner

*Primary Examiner* — John Ricci
(74) *Attorney, Agent, or Firm* — Robert L. Lundstrom

(57) ABSTRACT

A blade-opening arrowhead device includes an arrowhead body having a plurality of longitudinal blade slots on an outer surface and a flexible cam slot extending through a center portion of the body. A blade is pivotally disposable in one of the blade slots and pivotable between a retracted position and an open position. A flexible cam is disposable in the flexible cam slot. The flexible cam is configured to engage and rotate with the blade as the blade moves into the blade slot.

18 Claims, 4 Drawing Sheets

BROAD HEAD ARROW TIP AND ASSOCIATED METHODS

PRIORITY CLAIM

This patent application claims benefit of U.S. Provisional Patent Application No. 61/923,760, filed on Jan. 5, 2014, which is incorporated by reference in its entirety for all purposes.

BACKGROUND OF THE INVENTION

1. Field of the Invention

The present invention relates generally to archery products and more particularly to arrow tips.

2. Related Art

Many mechanical broadhead arrow tips have movable blades that can be stowed during flight and deploy upon impact. The blades are stowed in a retracted position during flight to provide aerodynamic stability to the arrow during flight. Upon impact the blades are deployed to an extended position that enlarges the cutting profile of the arrow tip.

One of the biggest challenges to mechanical broadhead arrow tips is retaining the blades in the retracted position during use. The blades must remain in the retracted position during storage, knock and flight in order to minimize storage space when quivered and to improve aerodynamics during flight. Unfortunately, it is sometimes difficult for an archer to tell when the blades are properly positioned in the retracted position which can result in premature deployment of the blades during flight. Such early deployment can result in an undesirable flight path of the arrow.

Additionally, upon impact, the blades must overcome the retention mechanism that holds the blades in the retracted position in order to open the blades to the deployed position so as to increase the cutting size of the arrowhead. Regrettably, many known blade retention mechanisms often fail to release the blades to the deployed position upon impact of the arrowhead.

SUMMARY OF THE INVENTION

The inventor of the present invention has recognized that it would be advantageous to develop a mechanical broadhead arrow tip that retains movable expanding blades in a stowed or retracted position during flight and which allows the blades to move to an open extended position upon impact. Additionally, the inventor has recognized that it would be advantageous to develop a mechanical broadhead arrow tip that produces a tactile feedback to the archer when the archer has properly positioned the blades in the retracted position. Moreover, the inventor has recognized that it would be beneficial to develop a mechanical broadhead arrow tip that includes a target material catch that facilitates deployment of the blades upon impact with a target.

The present invention provides a blade-opening arrowhead device including an arrowhead body having a plurality of longitudinal blade slots on an outer surface and a flexible cam slot extending through a center portion of the body. A blade can be pivotally disposable in one of the blade slots and pivotable between a retracted position and an open position. A flexible cam can be disposable in the flexible cam slot. The flexible cam can be configured to engage and rotate with the blade as the blade rotates into the blade slot. The flexible cam can deform under load from the blade and apply a resistive force against the blade in the retracted position to maintain the blade in the retracted position until a sufficient external force overcomes the wedging force and pivots the blade to the open position.

In another aspect the invention provides for a blade opening arrowhead device including an arrowhead body having a blade slot extending longitudinally between a rearward end toward a forward end with a corresponding pivot pin hole near the rearward end. A blade can be disposed in the blade slot and can have a forward end, an opposing rearward end having a pivot pin hole, and a cutting edge extending therebetween. A pivot pin can be disposed in the pivot pin holes of the arrowhead body and blade to rotatably connect the rearward end of the blade to the arrowhead body such that the blade can rotate between a retracted position, wherein the blade is positioned in the blade slot, and an open position, wherein the forward end of the blade is rotated away from the arrowhead body. A blade catch can be associated with the forward end of the arrowhead body adjacent to the forward end of the blade when the blade is in the retracted position. The blade catch can be sized and shaped to increase engagement of the forward end of the blade with material from a target such that the target material can force the blade out of the blade slot and into the deployed position as the arrowhead moves through a target.

The present invention also provides for a method for making a blade-opening arrowhead device including obtaining an arrowhead body having a plurality of blade slots. A pivotal blade can be attached to the arrowhead body with the blade pivotable between an open position and retracted position. A flexible cam can be placed within the arrowhead body such that the flexible cam can engage the blade as the blade is rotated to into the blade slot and provide a resistive force against the blade when the blade is in the retracted position.

The present invention also provides for a method for using a blade-opening arrowhead device including rotating a blade from an open deployed position to a retracted stowed position within a slot of an arrowhead body. A flexible cam positioned within the slot can be engaged with the blade such that the blade contacts a tab on the cam and friction between the blade and the tab causes the flexible cam to rotate with the blade as the blade moves into the slot. The flexible cam can be deformed with forces from the blade against the cam causing the cam to increase in surface area contact with the blade such that resistive forces from the cam to the blade are subsequently increased an amount that is proportional to the increased surface area of the flexible cam contacting the blade.

Additional features and advantages of the invention will be apparent from the detailed description which follows, taken in conjunction with the accompanying drawings, which together illustrate, by way of example, features of the invention.

DETAILED DESCRIPTION

Figure 1:
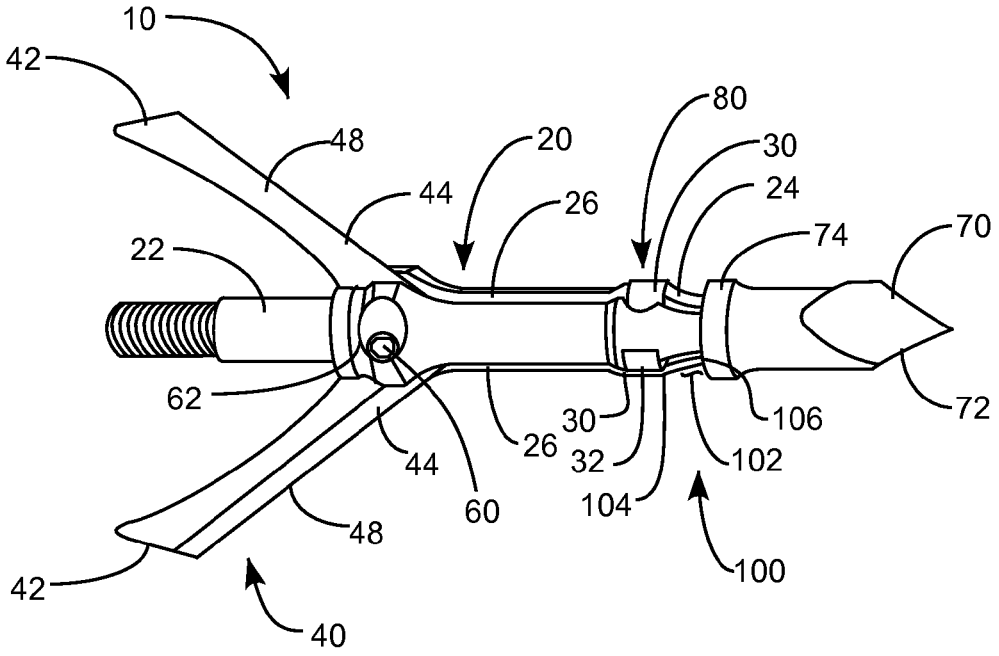
FIG. 1 is a perspective side view of a blade-opening arrowhead device in accordance with an embodiment of the present invention, shown with a plurality of blades in an open configuration.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The embodiments of the present invention described herein generally provide for a broadhead arrow tip with extendable blades that move between a retracted, stowed position and an extended, deployed position. During flight the blades are positioned and retained in the retracted position in a slot in the broadhead body. Upon impact and as the broadhead travels through a target, the blades are deployed to the extended position thereby increasing the cutting size of the broadhead tip. The blades are retained in the retracted position by mechanical force exerted on the blade by a flexible cam that can press against the blade providing a force on the blade that is resistive to movement of the blade. The flexible cam can rotate against the blade as the blade is moved into the slot on the arrowhead body. As the blade rotates the flexible cam, the cam can be stretched and deformed such that the surface area of the flexible cam contacting the blade increases as the blade is moved further into the slot on the arrow head body. As the surface area of the flexible cam contacting the blade increases, the resistive force applied to the blade by the flexible cam also increases a proportional amount to the increase in surface area. Eventually the elastic properties of the flexible cam can provide a force sufficiently strong enough to overcome the frictional forces of the blade on the flexible cam such that the flexible cam will slip or snap back into a less stressed, but still deformed and stretched state, while still providing enough resistive force to the blade to retain the blade in the retracted position during flight. The snap back of the flexible cam can be felt by a user of the present invention and in this way provides a tactile feedback to the user when the user has properly positioned the blades in the retracted position.

In another embodiment of the present invention, the flexible cam can be interconnected to other flexible cams associated with each of a plurality of blade slots in the arrowhead body. In this case, deformation by a blade on one of the flexible cams can cause stress, deformation and stretching in the other flexible cams thereby increasing the resistive forces on all of the blades simultaneously as the plurality of blades are rotated to the retracted position. Additionally, leaving one of the plurality of blades in the open position while closing the other blades can cause a decrease in overall force of the flexible cams on the remaining blades in the closed position.

Upon impact, the blade can be snagged by target material as the arrow head penetrates a target and the forces on the blade from the target material can overcome the resistive forces from the flexible cam so that the blade can move into the extended, open or deployed position. The arrowhead body can include a cut-out recess near the forward edge of the stowed blades. The cut-out recess provides a space for target material to move into and fill around the blade as the arrowhead travels through the target. As the target material fills the space around the blade, the target material catches the blade and moves the blade to the deployed position as the arrow continues to travel through the target. In this way, the cut-out recess can provide a target material catch that facilitates deployment of the blades to the fully extended position.

Figure 2:
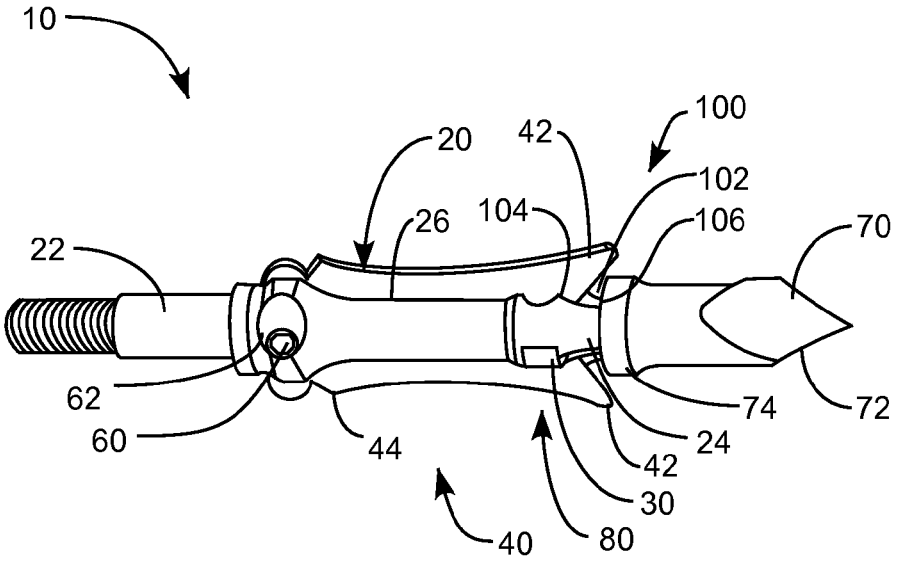
FIG. 2 is a perspective side view of the blade-opening arrowhead device of FIG. 1, shown with the blades in a retracted configuration.
Figure 3:
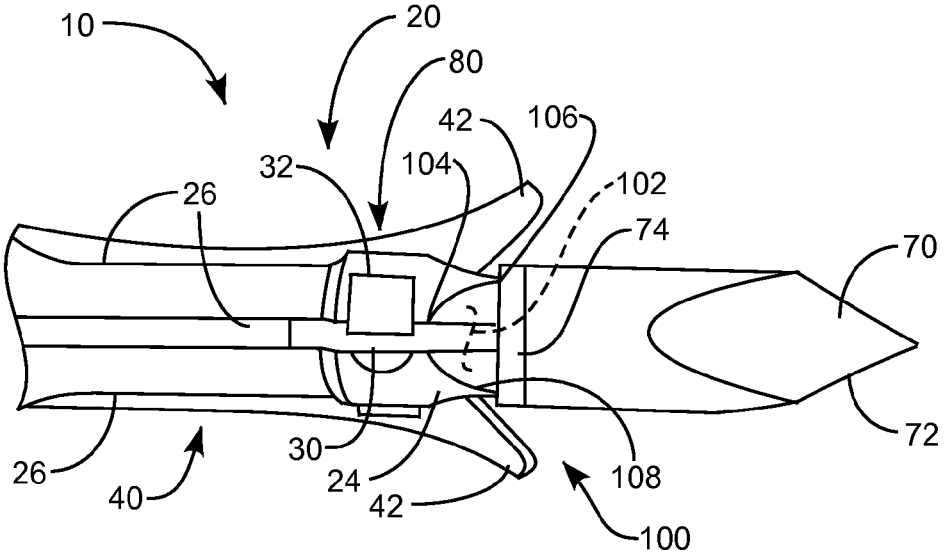
FIG. 3 is a partial side view of the blade-opening arrowhead device of FIG. 1, shown with two of the blades in the closed configuration.
Figure 4:
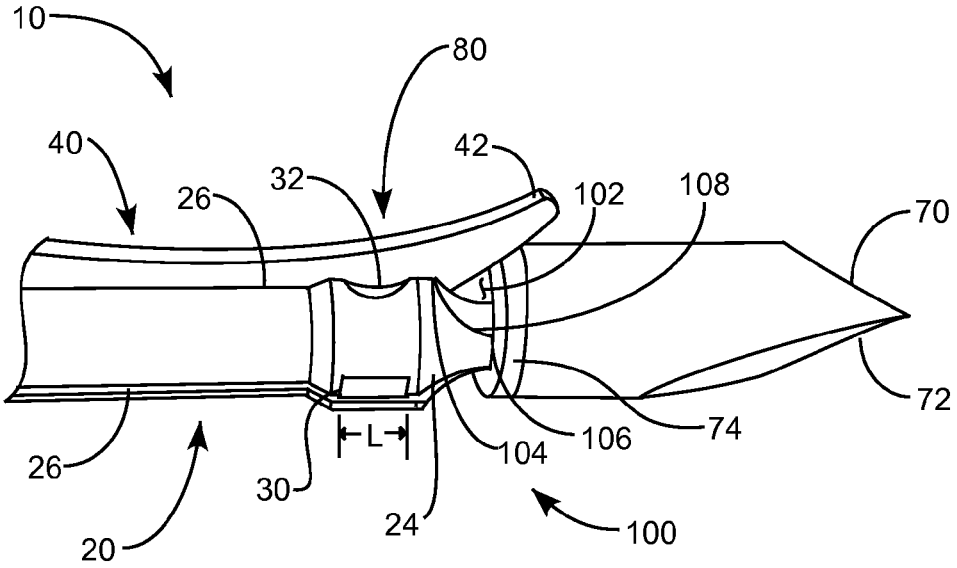
FIG. 4 is a partial side view of the blade-opening arrowhead device of FIG. 1, shown with one of the blades in the closed configuration.
Figure 5:
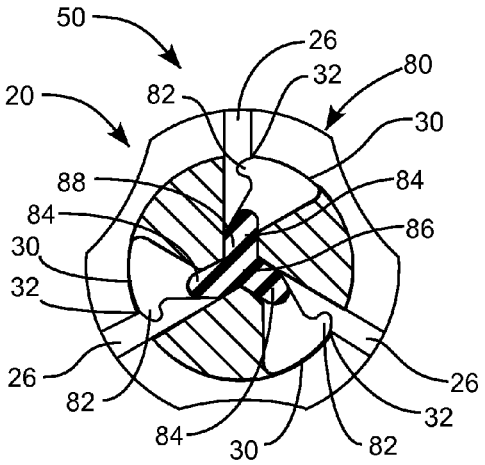
FIG. 5 is a cut-away end view of the blade-opening arrowhead device of FIG. 1, showing an end view of a flexible cam disposed within the arrowhead body and with no blades in the closed configuration.

As illustrated in FIGS. 1-4, a blade-opening arrowhead device, indicated generally at 10, is shown in accordance with an embodiment of the present invention for use in increasing the cutting size of the arrowhead device. The arrowhead device can include an arrowhead body, indicated generally at 20, and a plurality of blades, indicated generally at 40. Each of the plurality of blades is coupled to the arrow head body by a pivot pin 60. A flexible cam, indicated generally at 80, can be disposed in the arrowhead body 20 and can hold the blades 40 in a retracted position (FIG. 2).

The arrowhead body 20 can have a rearward end 22 and a forward end 24. A plurality of blade slots 26 can extend longitudinally between the rearward end 22 and the forward end 24. Each blade slot 26 can have a corresponding pivot pin hole 62 near the rearward end 22. The arrowhead body 20 can also have a flexible cam slot 30 that can be located between the forward end and rearward end. The flexible cam slot 30 can include an opening 32 through which the flexible cam 80 can extend into the blade slot 26 and contact the blade 40 when then blade is rotated into the retracted or closed position in the blade slot 26.

A chisel tip 70 with a cutting edge 72 can be coupled to the arrowhead body 20. The chisel tip can include a mount 74 that can be sized and shaped for mounting on the forward end 24 of the body.

Each of the plurality of blades 40 can be disposed in a different blade slot 26 when in the retracted position. Each blade 40 can have a catch end 42 and a pivot end 44. A cutting edge 48 can extend between the catch end 42 and the pivot end 44. The catch end 42 can catch or snag on to target material (not shown) as the arrowhead device 10 passes through a target. The target material can cause the catch end 42 of the blade to rotate rearward about the pivot end 44 of the blade 40 to the deployed or open position.

Additionally, a pivot pin hole (not seen) can be disposed in the pivot end 44 of the blade 40. The pivot pin hole can match up and align with the pivot pin hole 62 of the arrowhead body 20.

The pivot pin 60 can be disposed in the aligned pivot pin holes of the blade and arrowhead body so as to rotatably connect the pivot end 44 of the blade 40 to the arrowhead body 20. With the blade 40 pinned to the arrowhead body 20, the blade can rotate between a retracted position, as shown in FIG. 2 with the blade positioned in the blade slot 26, and an open position with the forward end 44 of the blade rotated away from the arrowhead body as shown in FIG. 1.

As best seen in FIGS. 5-10, the flexible cam 80 can be disposed in the flexible cam slot 30 of the arrowhead body 20. The flexible cam 80 can include a flexible material 86 such as a rubber material, an elastomeric material, a plastic material, a soft metal material, a compressible polymeric material, and the like. The flexible material 88 can have elastic properties such that the flexible cam 80 can be deformed under compressive or tensile forces (FIGS. 6-7) and return to a natural predetermined shape without permanent deformation when such forces are removed.

The flexible cam 80 can be sized and shaped to engage the blade 40 and apply a resistive force against the blade 40 when the blade is in the retracted position. The resistive force applied to the blade 40 by the flexible cam 80 can maintain the blade 40 in the retracted position until the catch end 44 (see FIGS. 1-4) of the blade 40 contacts a target (not shown) with sufficient force to overcome the resistive force applied by the flexible cam 80. In use, when the catch end 44 of the blade 40 contacts a target, material of the target can catch or snag onto the catch end 44 of the blade 40 and cause the blade 20 to pivot to the open position as the arrow moves through the target material.

The flexible cam's 80 size and shape can include an engagement tab 82. The engagement tab 82 can extend through the opening 32 into the blade slot where the tab 82 can engage the blade 40 as the blade is moved into the blade slot 26. Frictional forces between the blade 40 and the engagement tab 82 can cause the engagement tab to deform and move with the blade as the blade moves into the blade slot. The movement of the engagement tab 82 with the blade 40 can cause the flexible cam to rotate, as indicated by the arrow at 90, into the blade 40 in a cam-like motion with the motion of the blade, indicated by the arrow at 92, being essentially linear with respect to the rotation motion 90 of the flexible cam 80.

Figure 6:
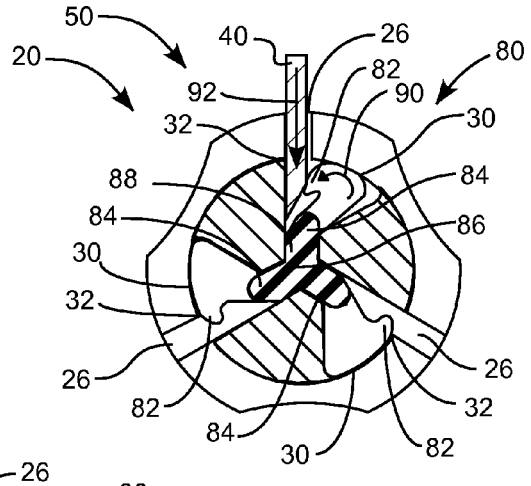
FIG. 6 is a cut-away end view of the blade-opening arrowhead device of FIG. 1, showing an end view of a flexible cam disposed within the arrowhead body and with one blade in a partially closed configuration position.

The rotation of the engagement tab 82 against the blade 40 can deform the engagement tab against the blade such that the surface area of the engagement tab 82 in contact with the blade can increase, as shown in FIG. 6. It will be appreciated that as the surface area of the engagement tab 82 in contact with the blade 40 increases, the resistive force exerted on the blade 40 by the flexible cam 80 also increases proportionally. In turn, the deformation of the flexible cam 80 increases proportionally to the forces exerted between the blade 40 and the flexible cam 80.

Figure 7:
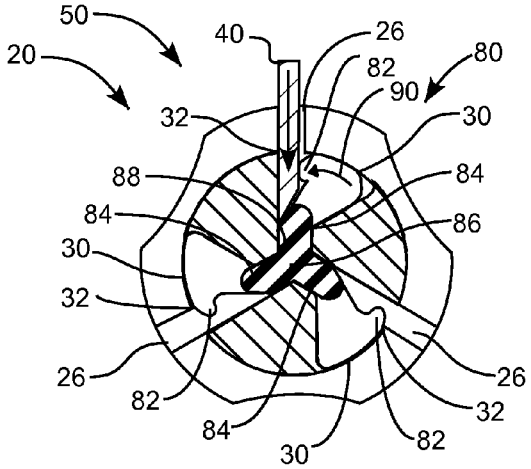
FIG. 7 is a cut-away end view of the blade-opening arrowhead device of FIG. 1, showing an end view of a flexible cam disposed within the arrowhead body and with one blade in a fully closed configuration position.
Figure 8:
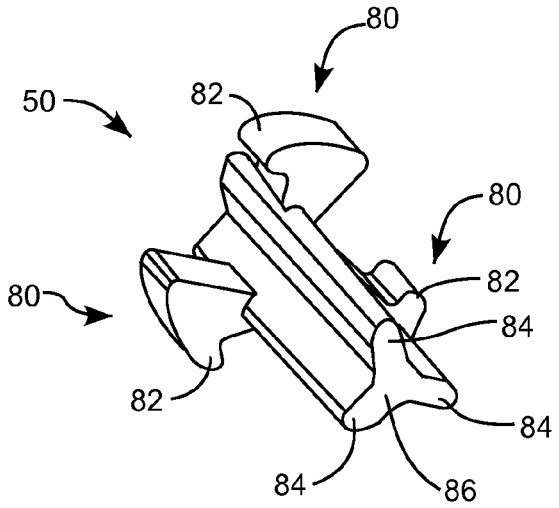
FIG. 8 is a perspective view of a flexible cam that can be disposed in the arrowhead device of FIG. 1 in accordance with an embodiment of the present invention.
Figure 9:
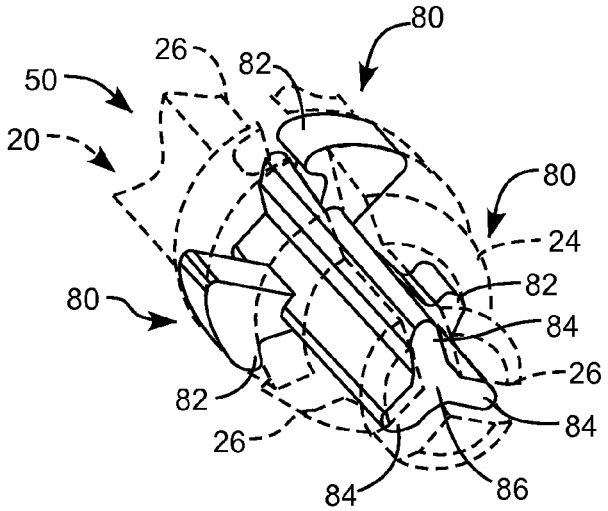
FIG. 9 is a perspective view of the flexible cam of FIG. 9 shown disposed within a cut-away hidden line view of an arrowhead body of the arrowhead device of FIG. 1.
Figure 10:
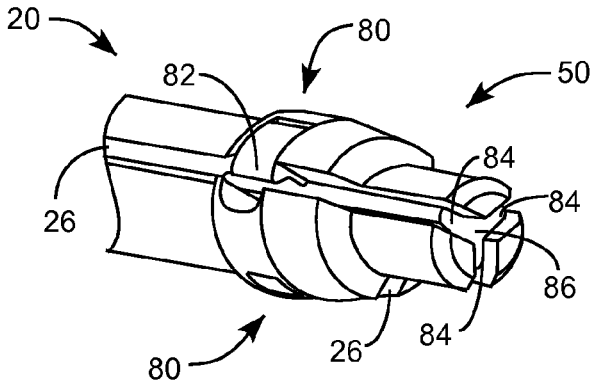
FIG. 10 is a perspective view of the flexible cam of FIG. 9 shown disposed within a cut-away perspective view an arrowhead body of the arrowhead device of FIG. 1.

Additionally, as the flexible cam 80 deforms and stretches under pressure from the blade 40, eventually the elastic properties of the flexible cam 80 can provide a force sufficiently strong to overcome at least some the frictional forces of the blade 40 on the flexible cam 80. In this way the flexible cam 80 and engagement tab 82 can slip or snap back into a less stressed but still deformed and stretched state, as shown in FIG. 7, while still providing enough resistive force to the blade 40 to retain the blade in the retracted position during flight of the arrow to which the arrow head device 10 is attached.

Advantageously, this sudden release of stress, or snap, in the flexible cam 80 can relieve sufficient stress and force within the flexible cam 80 such that the snap back action of the flexible cam 80 and tab 82 can be felt by the user as the blades 40 are pushed into the blade slots 26. In this way the arrowhead devices 10 described herein can provide a tactile feedback to a user indicating that the blades are properly positioned and locked in the fully retracted position in the blade slot. Hence, once the blades 40 are in the retracted position and user has felt the flexible cam 80 snap into the less stressed state, the user need not worry about the blades 40 inadvertently opening to the deployed position where the very sharp cutting edge 48 of the blades may be exposed without the user's knowledge.

The flexible cam 80 can also be interconnected by a plurality of spokes 84 to other flexible cams such that the flexible cam is one of a plurality of flexible cams, indicated generally at 50 on the broadhead arrow 10. The plurality of spokes 84 can be joined together by a central hub 86. Each spoke 84 can be sized and shaped to position a flexible cam into a corresponding blade slot 26 so as to engage each flexible cam 80 with one of the plurality of blades 40 as the blades are rotated into the retracted position. In use, as each blade 40 engages a corresponding flexible cam 80 and each flexible cam is deformed by the blade engagement, the flexible cams 80, spokes 84, and central hub 86 can be stressed cumulatively in such a way as to increase the resistive forces of each of the flexible cams 80 against the movement of the each of the blades 40.

Additionally, the flexible cam 80 can extend for a predetermined longitudinal length L (FIG. 4) along the body 20 and the blade 40. The predetermined longitudinal length L can correspond to a desired resistive force against the blade 40. For example if a stronger resistive force is desired the flexible cam 80 can have a relatively longer longitudinal length L thereby contacting and exerting a greater resistive force against the blade 40. Similarly, if a weaker resistive force is desired, the flexible cam 80 can have a relatively shorter longitudinal length L such that the force exerted against the blade 40 is relatively smaller.

It is a particular advantage of the embodiments of the blade opening arrow head device 10 described herein that the flexible cam 80 can provide resistance to movement of the blades 40 within the blade slots 26 during flight of the arrow. In this way, the flexible cam 80 can stabilize the blades during flight so that unwanted movement, such as vibrations of the blades caused by high wind loads during flight can be reduced or even eliminated. Additionally, fluctuations in aerodynamic lift and wind planning caused by exposure of the blades can be minimized during flight of the arrow as the exposed portions of the blades are held relatively motionless by the flexible cam. Furthermore, the flexible cams 80 can reduce aeronoise or whistling caused by unwanted rapid movement of the blades during flight of the arrow.

Returning to FIGS. 1-4, the arrowhead device 10 can also include a blade catch, indicated generally at 100. The blade catch 100 can be positioned near the forward end 24 of the arrowhead body 20 adjacent to the catch end 42 of the blade 40 when the blade is in the retracted position. The blade catch 100 can have a size and shape that increases engagement of the catch end 42 of the blade 40 with material from a target when the arrowhead 10 moves through the target. In this way, the blade catch 100 can maximize the likelihood that the target material will catch onto and force the blade 40 out of the blade slot 26 and into the deployed position upon impact with a target.

In one aspect, the blade catch 100 can include a recess 102 that can be cut out from the forward end 24 of the arrowhead body 20. This recess 102 can expose a relatively greater portion of the catch end 42 of the blade 40 when the blade is in the retracted position. Having a greater portion of the catch end 42 of the blade 40 exposed by the recess 102 provides more opportunity for material from a target to engage with the blade 40 which in turn increases the forces acting on the blade that can act to disengage the blade 40 from the flexible cam 80.

As shown in FIGS. 1-4, the recess 102 can be a hemispherically shaped cut-out 108 (FIGS. 3-4) equally spaced about the blade slot 26. The recess 102 can gradually deepen or taper from an aft most position 104 to a forward position 106 that is adjacent the chisel tip 70. In one aspect, the hemispherically shaped cut-out can act like a scoop that can scoop up target material as the material moves past the chisel tip 70 and into the recess 102. Thus, in use, the recess 102 can allow target material to collect and fill around the catch end 42 of the blade 40 such that as the arrowhead device 10 travels through the target a greater portion of target material can engage and catch onto the catch end 44 of the blade 40 and can thus move the blade 40 to the deployed position.

Additionally, since the recess 102 can be sized and shaped to allow sufficient target material to engage the catch end 42 of the blade 40, less of the catch end of the blade needs to extend beyond the outer diameters of the chisel tip 70 and the arrowhead body 20. Accordingly, the catch end 42 of the blade 40 can be positionable to a relatively closer position to the arrowhead body 20. It will be appreciated that having less of the blade 40 extending beyond the arrowhead body 20 and chisel tip 70 can significantly reduce unwanted aerodynamic forces on the blades 40 and arrowhead device 10 which can increase the accuracy of the arrow to which the arrowhead device 10 is attached during flight.

The present invention also provides for a method for making a blade-opening arrowhead device including obtaining an arrowhead body having a plurality of blades. A pivotal blade can be attached to the arrowhead body with the blade pivotable between an open position and retracted position. A flexible cam can be placed within the arrowhead body such that the flexible cam can rotate with and provide a resistive force against the blade when the blade is rotated to the retracted position.

The present invention also provides for a method for using a blade-opening arrowhead device including rotating a blade from an open deployed position to a retracted stowed position within a slot of an arrowhead body. A flexible cam positioned within the slot can be engaged with the blade such that the blade contacts a tab on the cam and friction between the blade and the tab causes the flexible cam to rotate with the blade as the blade moves into the slot. The flexible cam can be deformed with forces from the blade against the cam causing the cam to increase in surface area contact with the blade such that resistive forces from the cam to the blade are subsequently increased an amount that is proportional to the increased surface area of the flexible cam contacting the blade.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A blade-opening arrowhead device, comprising:

a) an arrowhead body having a plurality of blade slots extending longitudinally between a rearward end toward a forward end, each blade slot having a corresponding pivot pin hole near the rearward end;

b) a blade disposable in one of the blade slots and having a forward end, an opposing rearward end having a pivot pin hole, and a cutting edge extending therebetween;

c) a pivot pin disposable in the pivot pin holes of the arrowhead body and blade to rotatably connect the rearward end of the blade to the arrowhead body such that the blade rotates between a retracted position wherein the blade is positioned in the blade slot and an open position wherein the forward end of the blade is rotated away from the arrowhead body;

d) a flexible cam slot disposed in the arrowhead body extending from the forward end to an intermediate point between the forward end and rearward end of the arrowhead body; and e) a flexible cam disposable in the flexible cam slot and being sized and shaped to engage and rotate against the blade when the blade is moved into the retracted position in the blade slot to apply resistive forces against the blade to retain the blade in the retracted position.

2. The device of claim 1, wherein the flexible cam elastically deforms from contact and rotational engagement with the blade to increase a surface area of the flexible cam in contact with the blade.

3. The device of claim 2, wherein the surface area in contact with the blade increases as the blade is rotated further into the blade slot thereby proportionally increasing the resistive force on the blade as the blade is rotated into the blade slot.

4. The device of claim 1, wherein the resistive force from the deformed cam is sufficient to maintain the blade in the retracted position until the forward end of the blade contacts a target with sufficient force to overcome the wedging force and pivots the blade to the open position.

5. The device of claim 1, wherein the resistive force from the deformed cam restricts vibration of the blade in the blade slot when the blade is in the retracted position.

6. The device of claim 1, wherein the resistive force from the deformed cam restricts movement of the blade in the retracted position to reduce planing and lift of the arrow during flight.

7. The device of claim 1, wherein the flexible cam is operably coupled to flexible cams associated with other blade slots in the arrowhead body and is operable to increase the resistive force in the other flexible cams such that as the blade deforms the flexible cam when the blade is positioned in the blade slot, the deformation in the cam induces increased resistive forces in the other flexible cams as they are in turn deformed by blades rotated into the respective blade slots.

8. The device of claim 1, wherein the flexible cam is sufficiently elastic to resist the movement of the blade such that the flexible cam moves to a less deformed state once the elastic forces with the flexible cam are sufficiently high to overcome the frictional forces of the blade against the flexible cam.

9. The device of claim 1, wherein the flexible cam includes an engagement tab that contacts and moves with the blade as the blade moves into the blade slot until an elastic deformation limit is reached by the flexible cam at which point the engagement tab disengages the blade and slips to a less stressed state.

10. The device of claim 1, further comprising:

a recess associated with the forward end of the arrowhead body adjacent to the forward end of the blade when the blade is in the retracted position, the recess being sized and shaped to expose the forward end of the blade to sufficient target material so as to induce forces on the blade to overcome the resistive forces of the flexible cam on the blade to move the blade to the deployed position as the arrowhead moves through a target.

11. A blade opening arrowhead device, comprising:

a) an arrowhead body having a blade slot extending longitudinally between a rearward end toward a forward end, the blade slot having a corresponding pivot pin hole near the rearward end;

b) a blade disposable in the blade slot and having a forward end, an opposing rearward end having a pivot pin hole, and a cutting edge extending therebetween;

c) a pivot pin disposable in the pivot pin holes of the arrowhead body and blade to rotatably connect the rearward end of the blade to the arrowhead body such that the blade rotates between a retracted position wherein the blade is positioned in the blade slot and an open position wherein the forward end of the blade is rotated away from the arrowhead body;

d) a blade catch associated with the forward end of the arrowhead body adjacent to the forward end of the blade when the blade is in the retracted position, the blade catch being sized and shaped to increase engagement of the forward end of the blade with material from a target such that the target material forces the blade out of the blade slot and into the deployed position as the arrowhead moves through a target; and e) the blade catch including a hemispherically shaped recess cut out from the forward end of the arrowhead body and equally spaced about the blade slot thereby exposing a relatively greater portion of the forward end of the blade to the target material upon impact of the arrowhead with the target.

12. The device of claim 11, wherein the recess extends from a relatively larger rearward outer diameter of the arrowhead body toward a relatively smaller forward outer diameter of the arrowhead body.

13. The device of claim 12, further comprising a chisel tip coupleable to the forward end of the arrowhead body, the chisel tip having an relatively larger outer diameter than the forward outer diameter of the arrowhead body such that the recess is relatively larger adjacent the chisel tip and tapers to be relatively smaller adjacent the rearward outer diameter of the arrowhead body.

14. The device of claim 13, wherein the recess allows target material to collect and fill around the forward end of the blade such that as the arrowhead travels through the target a greater portion of target material catches the blade and moves the blade to the deployed position.

15. The device of claim 11, further comprising:

a) a flexible cam slot disposed in the arrowhead body extending from the forward end to an intermediate point between the forward end and rearward end of the arrowhead body; and b) a flexible cam disposable in the flexible cam slot and being sized and shaped to engage and rotate against the blade when the blade is moved into the retracted position in the blade slot to apply resistive forces against the blade to retain the blade in the retracted position.

16. A blade-opening arrowhead device, comprising:

a) an arrowhead body having a plurality of blade slots extending longitudinally between a rearward end toward a forward end, each blade slot having a corresponding pivot pin hole near the rearward end;

b) a blade disposable in one of the blade slots and having a forward end, an opposing rearward end having a pivot pin hole, and a cutting edge extending therebetween;

c) a pivot pin disposable in the pivot pin holes of the arrowhead body and blade to rotatably connect the rearward end of the blade to the arrowhead body such that the blade rotates between a retracted position wherein the blade is positioned in the blade slot and an open position wherein the forward end of the blade is rotated away from the arrowhead body;

d) a flexible cam slot disposed in the arrowhead body extending from the forward end to an intermediate point between the forward end and rearward end of the arrowhead body;

e) a flexible cam disposable in the flexible cam slot and being sized and shaped to engage and rotate against the blade when the blade is moved into the retracted position in the blade slot; and f) a blade catch associated with the forward end of the arrowhead body adjacent to the forward end of the blade when the blade is in the retracted position, the blade catch having a shape that facilitates engagement of the forward end of the blade by material from a target such that the target material applies sufficient forces on the blade to overcome the engagement of the flexible cam on the blade such that the blade is forced out of the blade slot and into the deployed position as the arrowhead moves through a target.

17. The device of claim 16, wherein the blade catch includes a recess cut out from the forward end of the arrowhead body thereby exposing a relatively greater portion of the forward end of the blade to the target material upon impact of the arrowhead with the target.

18. The device of claim 17, wherein the recess is sized and shaped to allow sufficient target material to engage the forward end of the blade such that the forward end of the blade is positionable relatively closer to the arrowhead body thereby reducing aerodynamic forces on the exposed forward end of the blade.

* * * * *